US010638583B1

(12) United States Patent
Reusch et al.

(10) Patent No.: US 10,638,583 B1
(45) Date of Patent: Apr. 28, 2020

(54) METHOD FOR CONTROLLING A LIGHT EFFECT OF A LIGHTING SYSTEM WITH THE AID OF A LIGHTING CONTROL CONSOLE

(71) Applicant: MA Lighting Technology GmbH, Waldbüttelbrunn (DE)

(72) Inventors: Olaf Reusch, Maidbronn (DE); Michael Adenau, Wuerzburg (DE)

(73) Assignee: MA LIGHTING TECHNOLOGY GMBH, Waldbüttelbrunn (DE)

( * ) Notice: Subject to any disclaimer, the term of this patent is extended or adjusted under 35 U.S.C. 154(b) by 0 days.

(21) Appl. No.: 16/445,437

(22) Filed: Jun. 19, 2019

(30) Foreign Application Priority Data

Mar. 26, 2019 (DE) ..... 10 2019 107 669

(51) Int. Cl.
*H05B 47/155* (2020.01)
*F21V 21/15* (2006.01)
*F21W 131/406* (2006.01)

(52) U.S. Cl.
CPC ..... *H05B 47/155* (2020.01); *F21V 21/15* (2013.01); *F21W 2131/406* (2013.01)

(58) Field of Classification Search
CPC ..... H05B 33/0845; H05B 6/062; H05B 33/0815; H05B 33/0827; H05B 33/0863; H05B 33/089; H05B 33/0842; H05B 33/086; H05B 33/0869; H05B 33/083
See application file for complete search history.

(56) References Cited

U.S. PATENT DOCUMENTS

2004/0210916 A1* 10/2004 Hori ..... C11D 3/0084 720/600

* cited by examiner

*Primary Examiner* — Wei (Victor) Y Chan
(74) *Attorney, Agent, or Firm* — Quarles & Brady LLP

(57) ABSTRACT

A method for controlling a lighting system with the aid of a lighting control console (01), having the following method steps, a) establishing at least two points of intersection (12, 13, 17, 19, 24) in the adjusting range plane (09), each point of intersection (12, 13, 17, 19, 24) being defined by way of a pair of values that consists of at least two adjusting values;

b) calculating an effect function curve (14, 16, 18, 21, 23) that links all points of intersection (12, 13, 17, 19, 24) in the adjusting range plane (09);

c) selecting adjusting value combinations (15) that are in each case located on the effect function curve (14, 16, 18, 21, 23);

d) transmitting the selected adjusting value combinations (15) from the effect function curve (14, 16, 18, 21, 23) as adjusting commands to the lighting device.

14 Claims, 12 Drawing Sheets

METHOD FOR CONTROLLING A LIGHT EFFECT OF A LIGHTING SYSTEM WITH THE AID OF A LIGHTING CONTROL CONSOLE

This application claims priority to German Patent Application No. 10 2019 107 669.2 filed Mar. 26, 2019, which is incorporated herein by reference in its entirety.

The disclosure relates to a method for controlling a lighting system for generating a light effect using a lighting control console.

Lighting control consoles serve for controlling lighting systems such as those employed in theaters and on concert stages, for instance. Routinely, said lighting systems comprise a plurality of lighting devices, for instance stage spotlights, wherein the lighting devices on their own in many cases can be switched between a plurality of lighting states, for instance between different colors. These different lighting states of the lighting devices are controlled in the lighting program of the lighting control console by way of programmed adjusting parameters. While the lighting program is running, the adjusting parameters are then transmitted as adjusting commands, for instance as DMX commands, to the lighting devices via corresponding data links. Common lighting systems may comprise up to several thousand lighting devices.

So-called light effects are particularly important for the creation of stage shows. These light effects are program sections of the lighting program that continuously run specific adjusting value combinations of the adjusting parameters to be set. By generating such a light effect, a specific spotlight can, for instance, be controlled to that effect that it performs a predetermined motion curve, for instance a circular motion, on the stage with its cone of light. The generation of the light effects is in each case based on the fact that specific adjusting value combinations are generated and transmitted to the lighting device in order to realize the desired effects in this manner.

A disadvantage of the known methods for controlling lighting systems with the aid of a lighting control console for the purpose of generating light effects is that programming the adjusting value combinations that are required hereunto is highly complex and therefore demands an increased expenditure of time. Programming complex light effects therefore cannot be realized in many stage shows since the programming would be too time-consuming for the light show creator.

Starting from this state of the art, it is therefore the object of the present disclosure to propose a new method for controlling a lighting system with the aid of a lighting control console, said method allowing for light effects to be generated very easily and very fast.

This object is attained by a method according to the teachings of claim 1.

Advantageous embodiments of the disclosure are the subject-matter of the dependent claims.

The method in accordance with the disclosure is based on the fundamental idea that the at least two adjusting parameters that are supposed to be utilized for creating the light effect form an adjusting range plane. The limits of the adjusting range plane are defined by way of the physical limits of the settable adjusting range of the lighting device, for instance by way of the maximum adjusting angle of an adjustable lamp or by way of the maximum brightness of a spotlight. For controlling the light effect, points from the adjusting range plane now have to be selected, each point in the adjusting range plane defining an adjusting value combination that can be transmitted to the lighting device as adjusting commands.

For generating the light effect, it is now envisaged in accordance with the disclosure that at least two points of intersection are initially established in the adjusting range plane. Each of these points of intersection is defined by a pair of values of the two adjusting values that form the adjusting range plane.

Subsequently, with the aid of a predetermined algorithm, an effect function curve is calculated that links all points of intersection in the adjusting range plane. The effect function curve covers all points in the adjusting range plane that are subsequently eligible as adjusting value combinations for generating the light effect.

Subsequently, adjusting value combinations are then selected that are located on the effect function curve.

In a final step, the adjusting value combinations that are selected from the effect function curve are then transmitted from the lighting control console to the lighting devices in order to execute the light effect on the stage. The adjusting value combinations can be transmitted in the manner of DMX commands.

Which adjusting parameters are selected for generating the light effect is basically arbitrary and depends on the type of the desired light effect. As potential adjusting parameters for forming the adjusting range plane when the method in accordance with the disclosure is carried out, the brightness and/or the color (color channels) and/or the zooming factor are eligible, for instance.

Specific motion sequences of lighting devices that are mounted so as to be adjustable are of utmost importance for creating light effects.

Particularly significant is the setting of lighting devices that are pivotable about two pivot axes. The two adjusting angles of the lighting devices that are pivotable about the pivot axes are usually referred to as pan and tilt. In order to be able to define specific motion sequences of these lighting devices in light effects, it is therefore particularly advantageous if the two adjusting angles (pan and tilt) of the pivotable lighting devices define the two adjusting value axes of the adjusting range plane.

In order to allow for smooth transitions when controlling a light effect, it is advantageous if the effect function curve is calculated as a continuous function without any discontinuity in the function graph.

Which algorithm is taken to calculate the effect function curve after the points of intersection in the adjusting range plane have been established is basically arbitrary. This calculation can be effected particularly easily and precisely if the effect function curve is calculated as a spline function to the nth degree. In particular spline functions to the second or third degree can be calculated very fast and in consequence almost in real time in order to link the points of intersection that have been established before in the adjusting range plane with the aid of a continuous effect function curve.

Furthermore, it is particularly advantageous if the effect function curve presents a circularly closed function graph. While the method in accordance with the disclosure is running, this circularly closed function curve can then be run through multiple times in succession when controlling the light effect in order realize corresponding repetitions of the light effect.

In order to give the creator of light effects another creative aspect, it is particularly advantageous if the gradient of the effect function curve in a point of intersection is predetermined as a boundary condition for the calculation of the effect function curve. In other words, this means that, when the effect function curve is calculated, not only the points of intersection themselves, but also the gradient in the points of intersection is predetermined as a boundary condition.

In which manner the gradient of the effect function curve is predetermined by the creator of the light effect is basically arbitrary. This can be realized particularly easily in that the creator predetermines a tangent in a point of intersection. The course of the tangent then yields the gradient of the effect function curve in the point of intersection.

In its basic form, the method in accordance with the disclosure serves for controlling a lighting system when realizing a light effect with the aid of a lighting device. Light effects, however, have a particularly ample effect if multiple lighting devices are involved at the same time. In accordance with a preferred method variant, it is therefore envisaged that, for the purpose of creating the light effect, multiple lighting devices are simultaneously actuated, a separate effect function curve being calculated for each lighting device. The effect function curves of the individual lighting devices can by all means also be identical or at least similar.

In which manner the adjusting range plane is displayed for the creator of the light effect is basically arbitrary. What is preferred is that the adjusting range plane is displayed at a screen of the lighting control console.

Furthermore, it is basically arbitrary in which manner the points of intersection in the adjusting range plane are established by the creator of the light effect. This can be realized particularly easily in that the screen of the lighting control console presents a touch-sensitive surface. The creator of the light effect can then establish the points of intersection in the adjusting range plane by touching the touch-sensitive surface of the screen. When the light effect is executed, individual adjusting value combinations that are located on the effect function curve have to be selected, corresponding to the program sequence.

In which manner the selection is made is basically arbitrary. In accordance with a preferred embodiment, it is envisaged that the selected adjusting value combinations from the effect function curve in each case have an equal distance on the effect function curve. This equal distance between the individual adjusting value combinations corresponds to a specific working frequency with which the lighting devices are actuated when the light effect is executed.

The method in accordance with the disclosure allows for a highly efficient creation and execution of light effects, in particular when the effect function curve of a spline function is calculated. Since such calculations can be carried out, with the aid of special hardware elements, with very short processing times and thus almost in real time, the calculation of the continuous effect function curve and the selection of the adjusting value combinations from the effect function curve are possible almost in real time. Hence, this means in other words that the light effect does not have to be computed and the corresponding adjusting value combinations do not have to be stored in tables anymore before the lighting program is executed. Instead, the individual adjusting value combinations are calculated in each case in real time during the actual sequence of the program, which increases the effectivity considerably.

Various aspects of the method in accordance with the disclosure are represented in the drawing in a schematized fashion and will be explained for exemplary purposes hereinafter.

Figure 1:
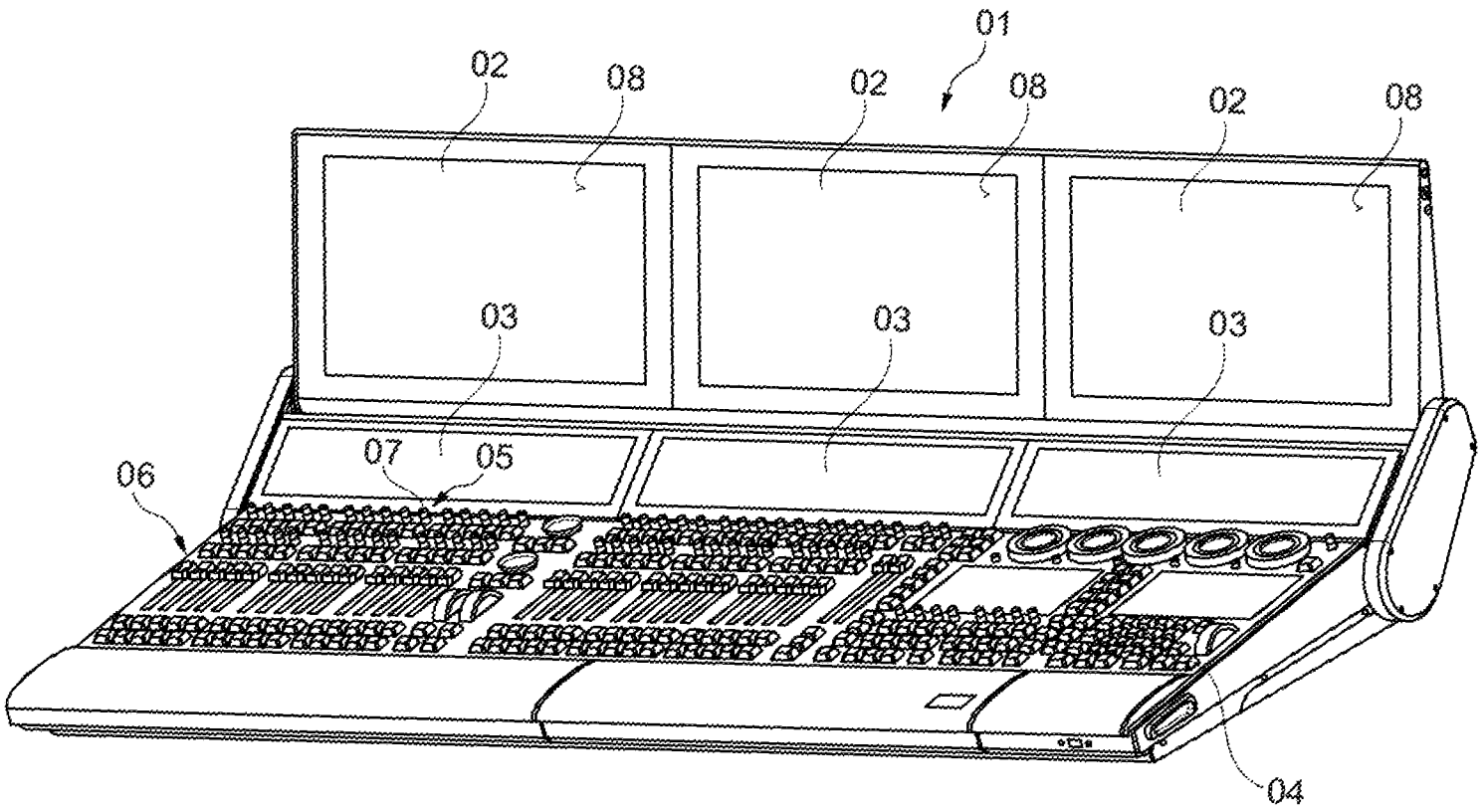
FIG. 1 shows a lighting control console that is suitable for carrying out the method in accordance with the disclosure in a perspective view from the front.

FIG. 1, in a perspective view, shows a lighting control console 01 for controlling a stage lighting system. The lighting control console is in particular suitable for generating light effects during a stage show using the method in accordance with the disclosure. The lighting control console is equipped with three monitors 02 and three monitors 03 for displaying various menus for the user. For entering adjusting commands, a plurality of push buttons 04, rotary controls 05 and slide controls 06 is provided at the lighting control console 01. The rotary controls 05 protrude beyond the housing of the lighting control console 01 with their rotary knobs 07. The screens 02 and 03 each present a touch-sensitive surface 08 so that the user can enter operating commands by touching the touch-sensitive surface 08.

Figure 2:
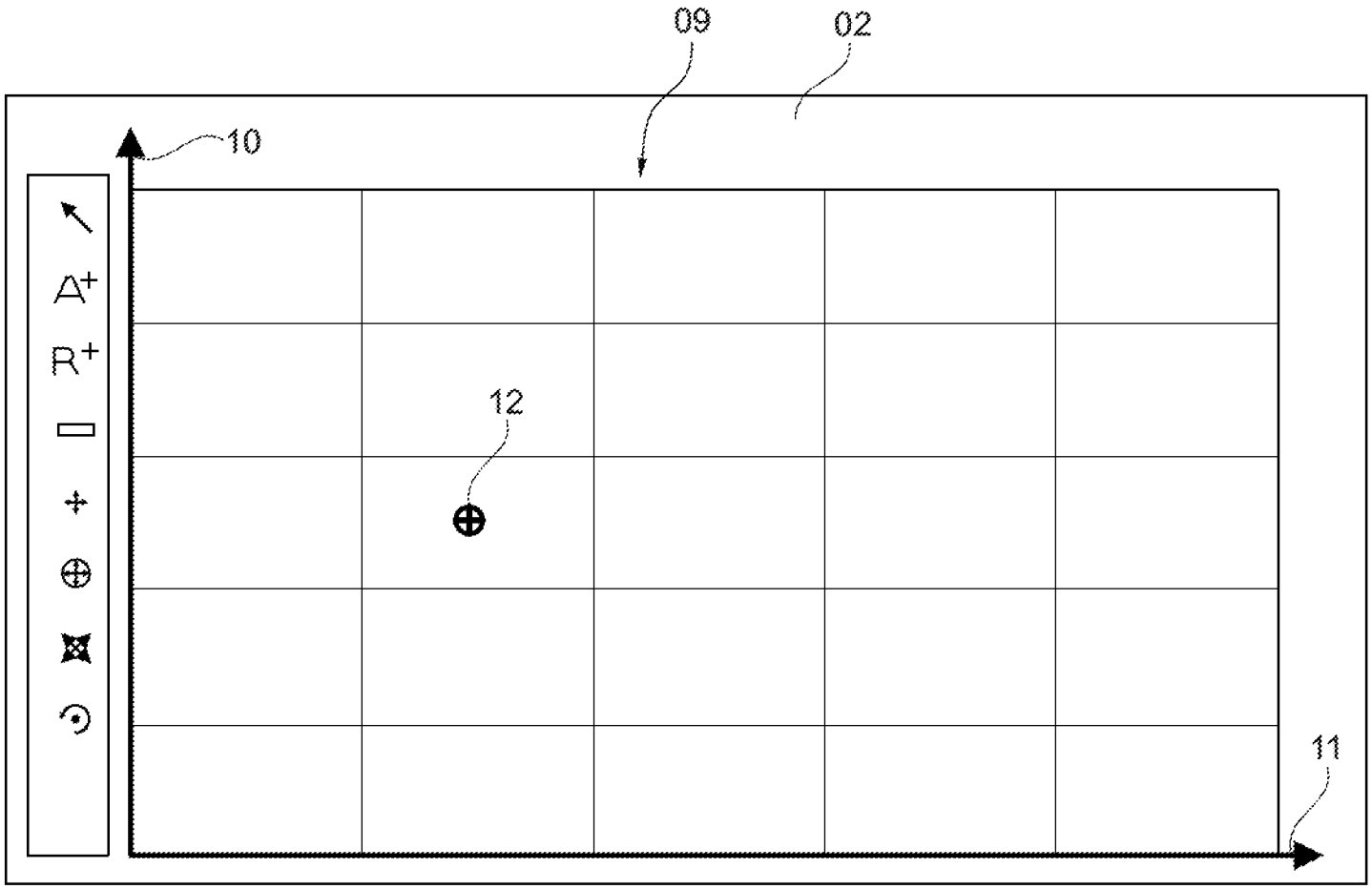
FIG. 2 shows the touch-sensitive screen of the lighting control console in accordance with FIG. 1, with the adjusting range plane that is displayed thereon when a first point of intersection for calculating an effect function curve is established.

FIG. 2 shows a screen 02 with its touch-sensitive surface 08 when the first processing step of the method in accordance with the disclosure is being carried out, in a view from the front. An adjusting range plane 09 is displayed to the user at the screen 02. The adjusting value axes 10 and 11 of the adjusting range plane 09 constitute the adjusting ranges of a lighting device, for instance of a stage spotlight. The first adjusting value axis 10 defines the first adjusting angle (pan) around a first adjusting axis of the lighting device. The second adjusting value axis 11 represents the second adjusting angle (tilt) around a second adjusting axis of the lighting device. The points that are present in the adjusting range plane 09 in each case thus stand for an adjusting value combination from the pan angle and the tilt angle that can be carried out by the corresponding stage spotlight with its adjusting mechanism.

In the first step of the method in accordance with the disclosure, the user touches a point of the surface 08 in the adjusting range plane 09, thereby defining the first point of intersection 12 that is the basis of the subsequent calculation of the effect function curve.

Figure 3:
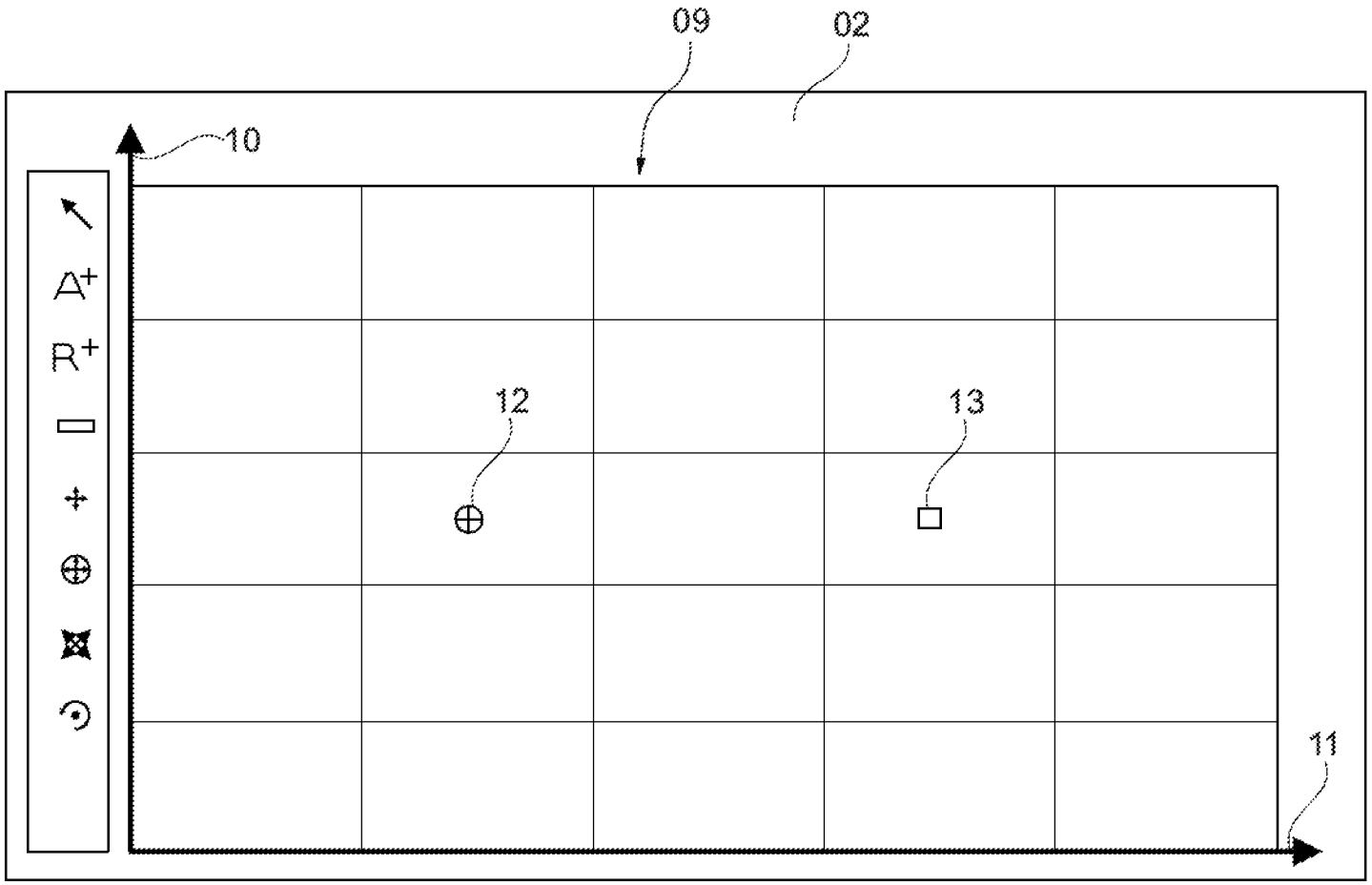
FIG. 3 shows the screen in accordance with FIG. 2 with the adjusting value plane that is displayed thereon when the second point of intersection for calculating an effect function curve is established.

FIG. 3 shows the adjusting range plane 09 at the screen 02 during the second step of the method in accordance with the disclosure. During the second step of the method in accordance with the disclosure, the user touches the surface 08 at a second point in the adjusting range plane 09, thereby defining a second point of intersection 13.

Figure 4:
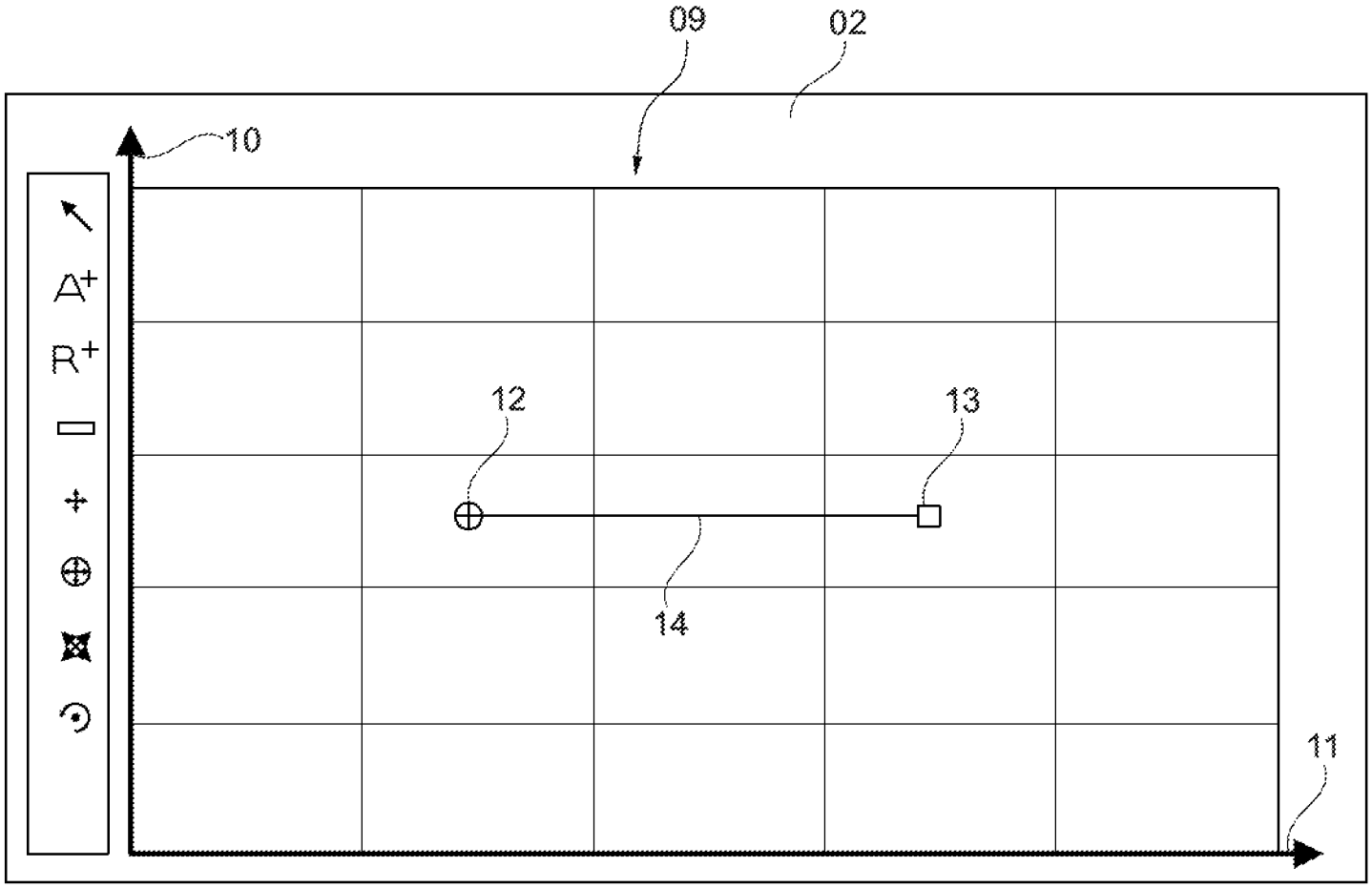
FIG. 4 shows the screen in accordance with FIG. 3 with the two points of intersection and with the effect function curve that links the points of intersection.

In the next step of the method in accordance with the disclosure, an effect function curve is calculated between the two points of intersection 12 and 13 in accordance with a predetermined algorithm. The option that is illustrated in FIG. 4 is the simplest effect function curve between the two points of intersection 12 and 13 since the effect function curve 14 corresponds to a straight line between the points of intersection 12 and 13. The effect function curve 14 covers all points in the adjusting range plane 09 with eligible adjusting value combinations for the subsequent execution of the light effect.

Figure 5:
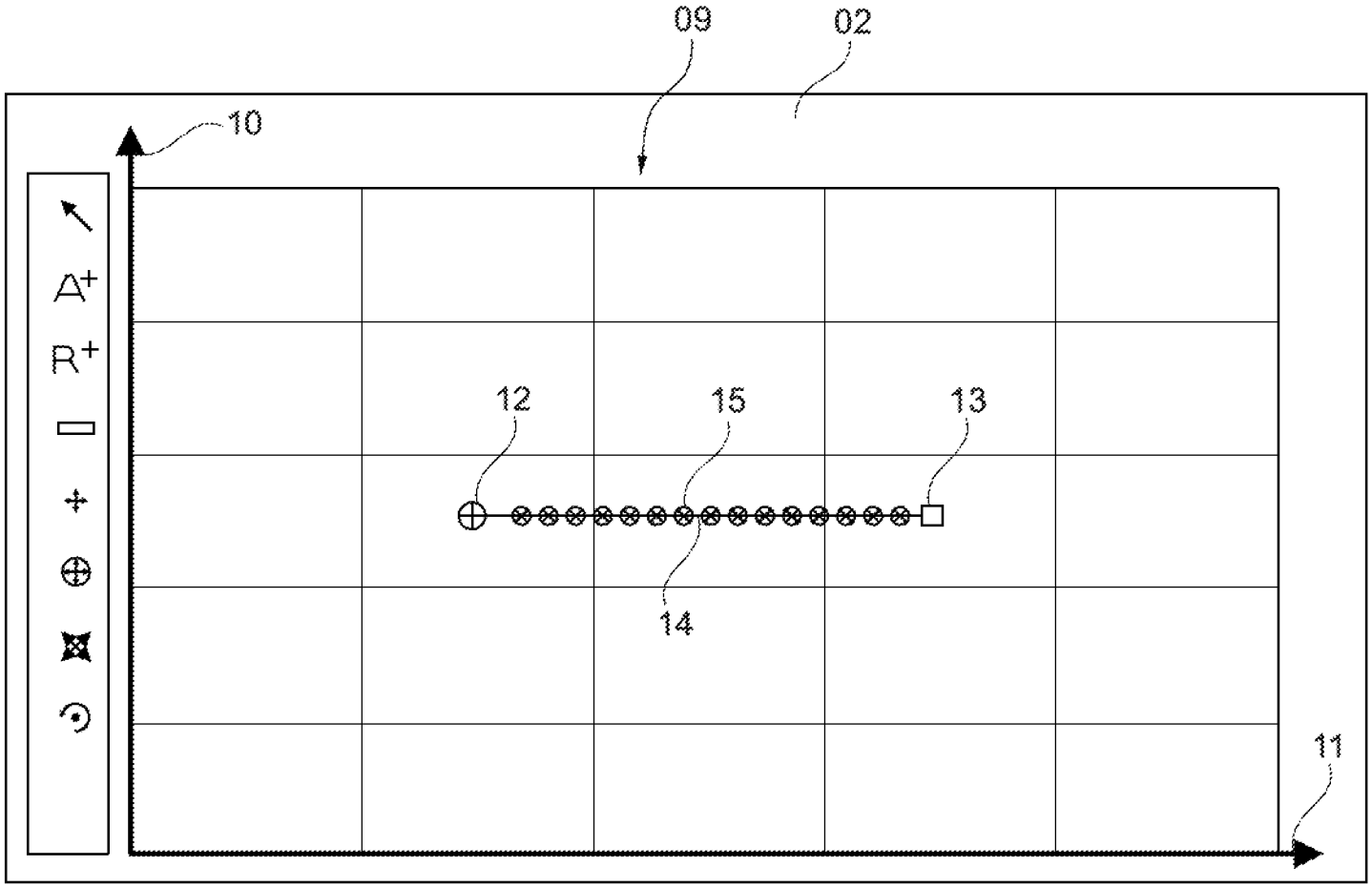
FIG. 5 shows the screen in accordance with FIG. 4 with multiple selected adjusting value combinations on the effect function curve.

FIG. 5 shows the adjusting range plane 09 at the screen 02 during the next step for carrying out the method in accordance with the disclosure. Multiple adjusting value combinations 15 are selected on the effect function curve 14. The adjusting value combinations 15 in each case define a specific combination from a pan angle and a tilt angle. The adjusting value combinations 15 have an equal distance from each other on the effect function curve 14. For executing the light effect, the adjusting values of the adjusting value combinations 15 are subsequently transmitted to the corresponding lighting device, namely the adjustable spotlight, with a specific frequency in order to realize a movement of the spotlight that determines the light effect.

Figure 6:
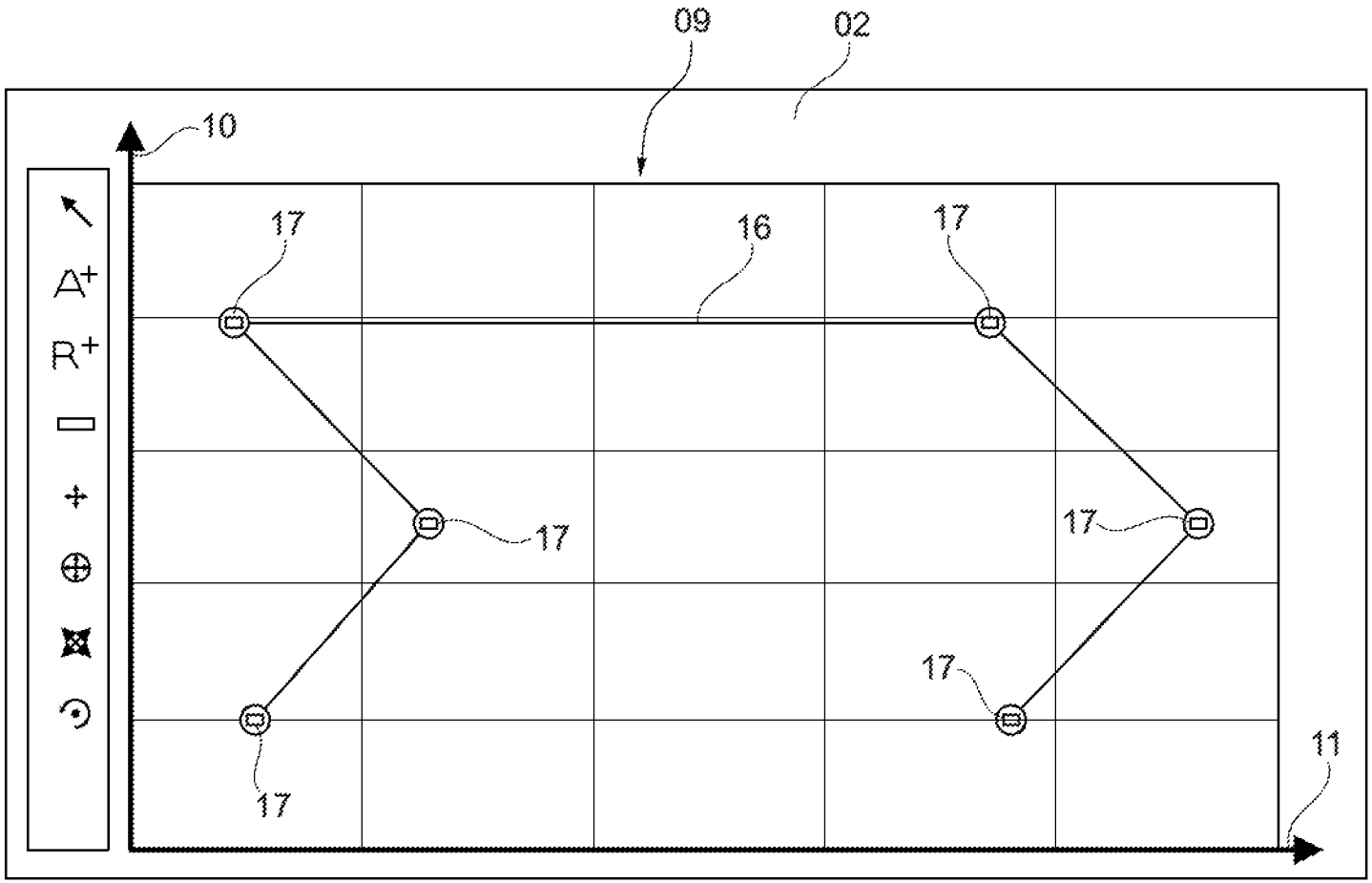
FIG. 6 shows the screen of the lighting control console in accordance with FIG. 1, having six points of intersection that are established in the adjusting value plane and an effect function curve that links the points of intersection.

FIG. 6 shows the screen 02 with the adjusting range plane 09 with a second effect function curve 16 that is displayed at said screen. The effect function curve 16 presents a circularly closed function graph so that the effect function curve 16 can repeatedly be run through when the light effect is generated. The effect function curve 16 is defined by way of the six points of intersection 17 that the user has selected by touching the touch-sensitive surface 08 at the screen 02. For calculating the effect function curve 16, the straight lines between the individual points of intersection 17 have been determined.

Figure 7:
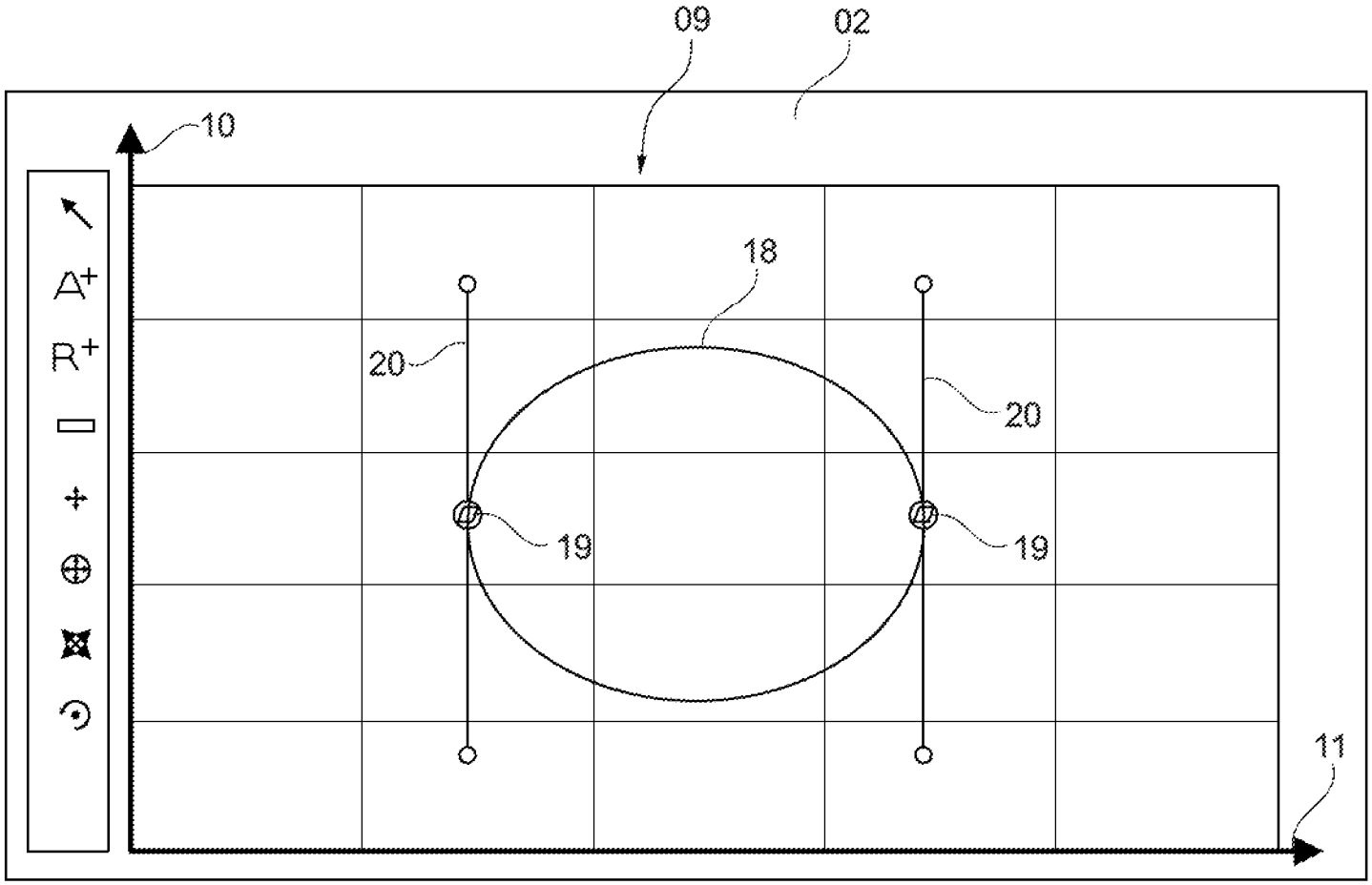
FIG. 7 shows the screen of the lighting control console in accordance with FIG. 1, having two points of intersection and two tangents at the points of intersection and having the effect function curve that has been calculated therefrom.

FIG. 7 shows the screen 02 with the adjusting range plane 09 when a third effect function curve 18 is displayed. The effect function curve 18 is defined by way of the two points of intersection 19 and the two tangents 20 that run through the points of intersection. The effect function curve 18 is calculated with the aid of a spline function to the third degree and presents a circularly closed function graph having a continuous function course.

Figure 8:
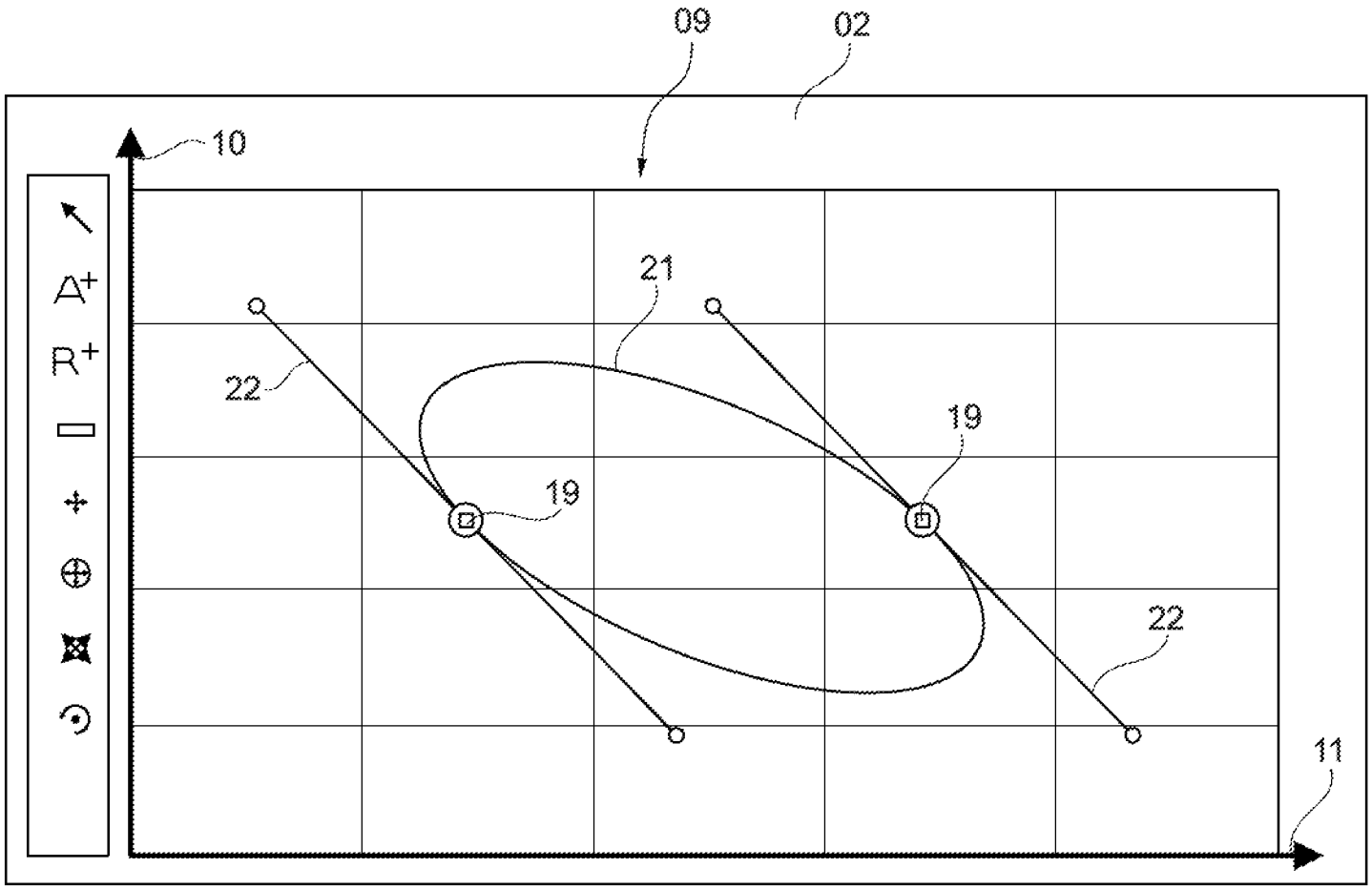
FIG. 8 shows the screen of the lighting control console in accordance with FIG. 1, having the two points of intersection in accordance with FIG. 7 after the course of the two tangents at the points of intersection and the effect function curve that has been calculated therefrom has been changed.

FIG. 8 shows the screen 02 with the adjusting range plane 09 when another effect function curve 21 is displayed. The effect function curve 21 is in turn defined by way of the two points of intersection 19 and two tangents 22 running through the points of intersection 19. By way of the altered course of the tangents 22 with respect to the tangents 20, the effect function curve 21 can be remodeled in a simple manner.

Figure 9:
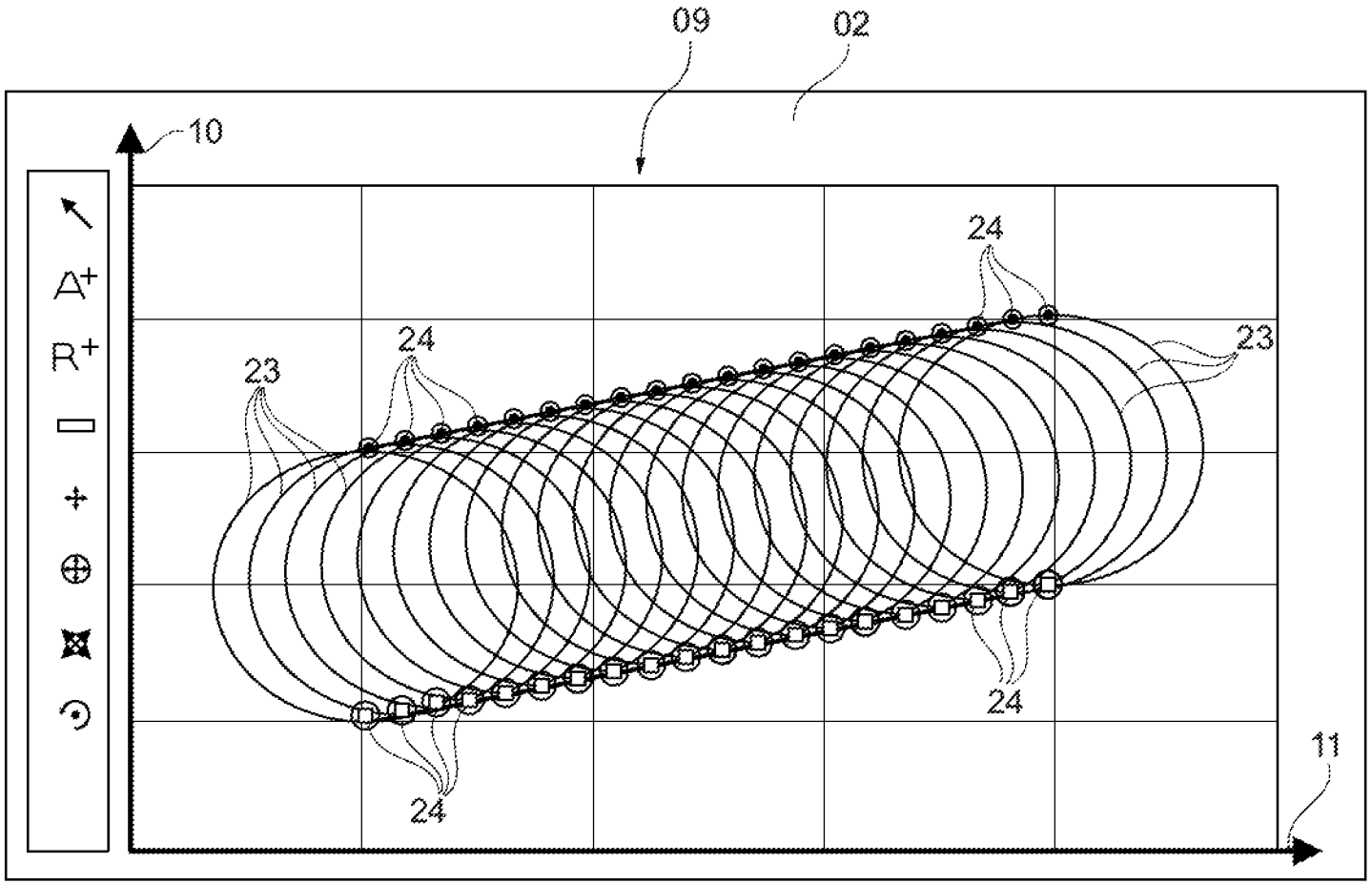
FIG. 9 shows the screen of the lighting control console in accordance with FIG. 1, having multiple effect function curves that are each defined by way of two points of intersection, for controlling multiple lighting devices.

FIG. 9 shows the screen 02 with the adjusting range plane 09 when a plurality of effect function curves 23 is displayed. Each effect function curve 23 is assigned to an individual spotlight. Since all effect function curves 23 have the same circular shape and are in each case defined by way of two points of intersection 24, the corresponding spotlights perform correspondingly few motion sequences when the light effect is executed.

Figure 10:
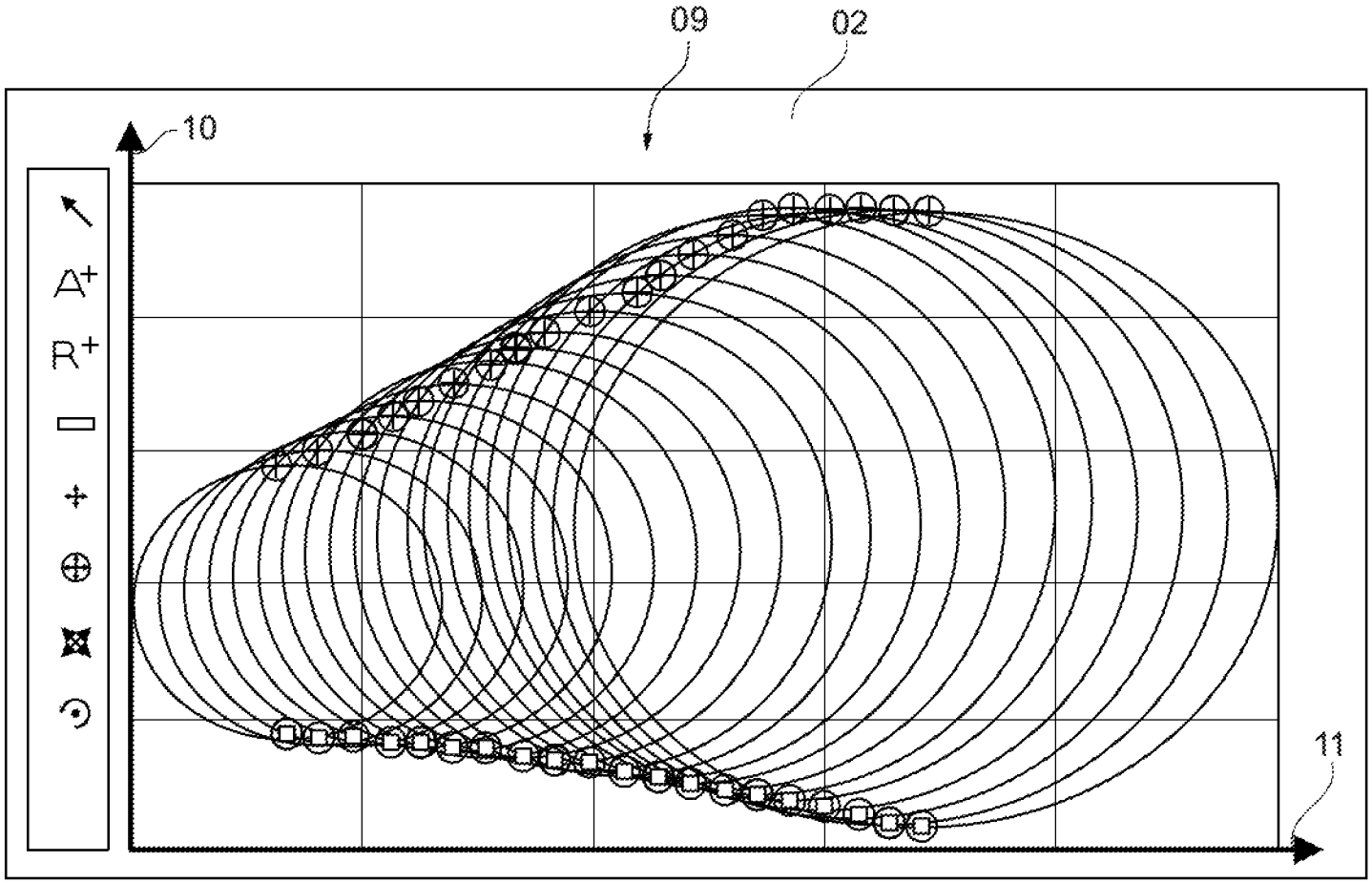
FIG. 10 shows the screen of the lighting control console in accordance with FIG. 1, having multiple effect function curves that are each defined by way of two points of intersection.

FIG. 10 shows the screen 02 with the adjusting range plane 09 when a plurality of effect function curves with similar function graphs is displayed, the diameter of the circular function graphs rising continuously in each case.

Figure 11:
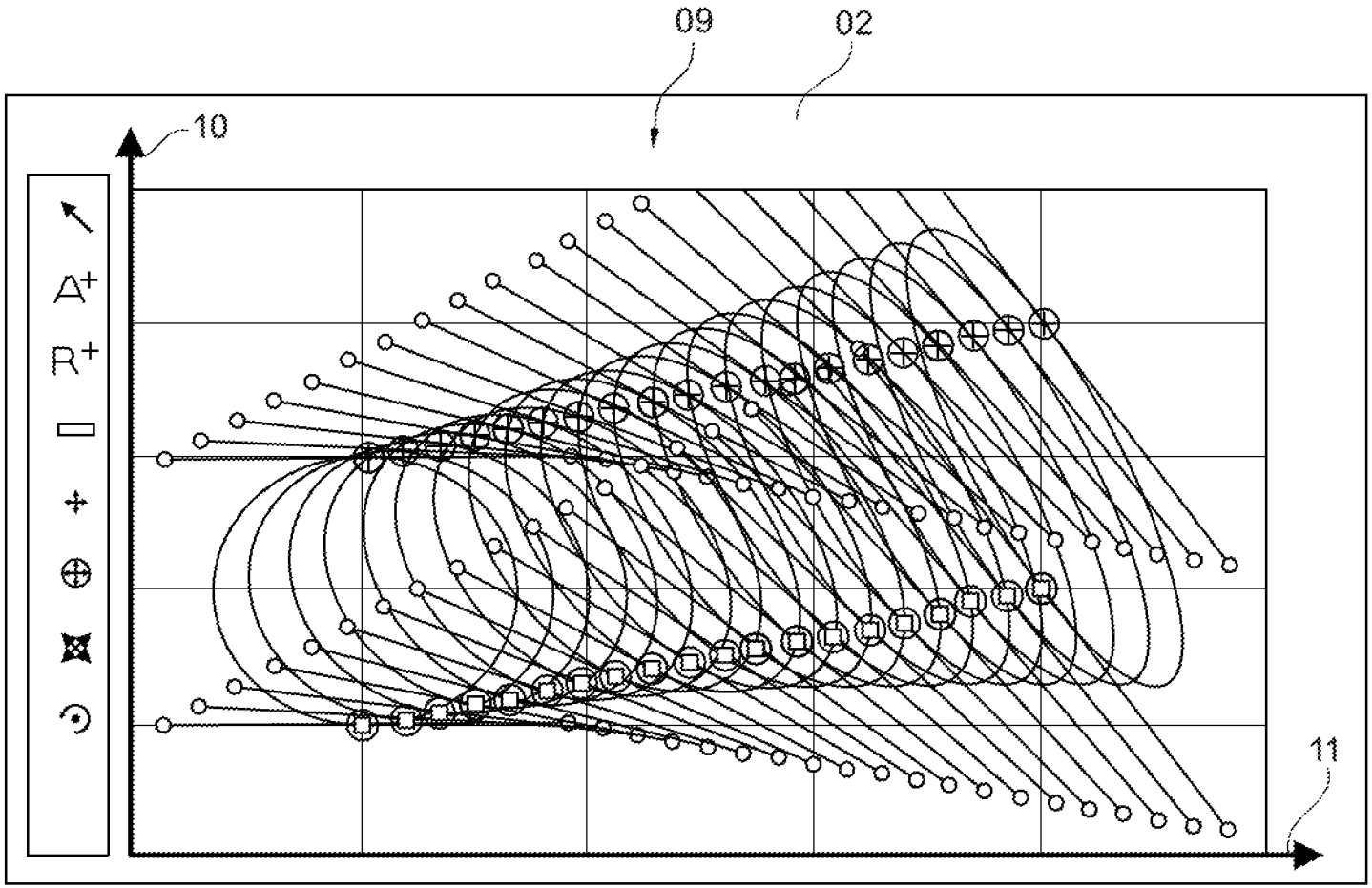
FIG. 11 shows the screen of the lighting control console in accordance with FIG. 1, having multiple effect function curves that are each defined by way of two points of intersection and two tangents, for controlling multiple lighting devices.
Figure 12:
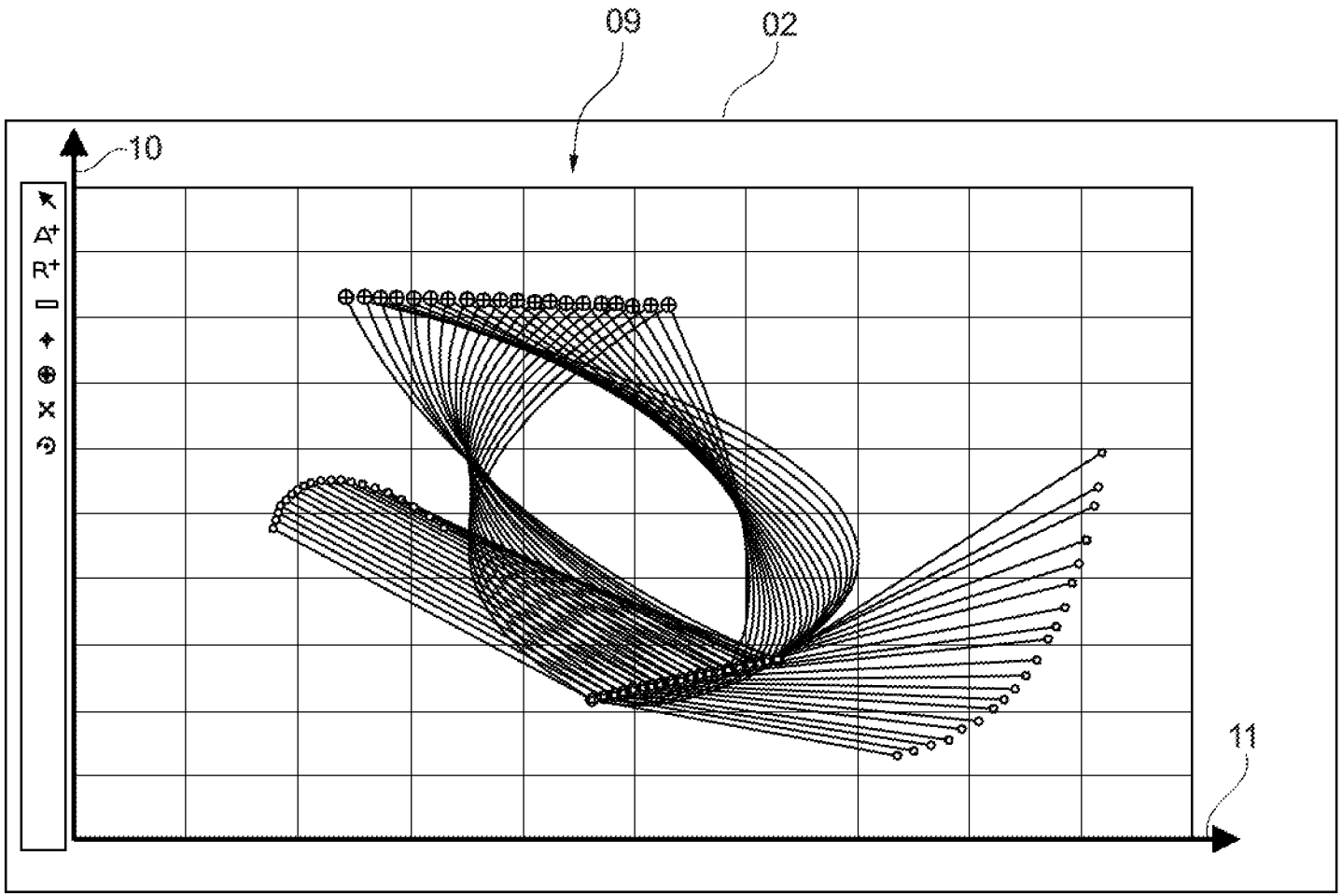
FIG. 12 shows the screen of the lighting control console in accordance with FIG. 1, having multiple complex effect function curves for controlling multiple lighting devices.

FIG. 11 and FIG. 12 show the screen 02 with the adjusting range plane 09 when further effect function graphs are displayed for controlling highly complex light effects by means of the lighting control console 01.

The invention claimed is:

1. A method for controlling a lighting system with the aid of a lighting control console, digital adjusting commands for controlling a light effect being generated in the lighting control console, and said adjusting commands being transmitted to at least one lighting device of the lighting system via data links, and at least two adjusting parameters for creating the light effect commands being settable by way of the adjusting commands at the lighting device, and said two adjusting parameters forming the adjusting value axes of an adjusting range plane, and, for controlling the light effect, adjusting value combinations that consist of at least two adjusting values of the two adjusting parameters from the adjusting range plane being in each case transmitted to the lighting device, having the following method steps, a) establishing at least two points of intersection in the adjusting range plane, each point of intersection being defined by way of a pair of values that consists of at least two adjusting values;

b) calculating an effect function curve that links all points of intersection in the adjusting range plane;

c) selecting adjusting value combinations that are in each case located on the effect function curve;

d) transmitting the selected adjusting value combinations from the effect function curve as adjusting commands to the lighting device.

2. The method according to claim 1, wherein at the lighting device, the brightness and/or the color and/or the zooming factor can be altered in order to be able to realize different lighting effects, the adjusting range plane comprising the brightness and/or the color and/or the zooming factor as the adjusting value axis.

3. The method according to claim 1, wherein the lighting device can be pivoted about two pivot axes with the aid of at least one actuator in order to be able to move towards different positions of the lighting device, the first adjusting angle (pan) around the first pivot axis and the second adjusting angle (tilt) around the second pivot axis forming the adjusting value axes of the adjusting range plane.

4. The method according to claim 1, wherein the effect function curve is calculated as a continuous function without any discontinuity in the function graph.

5. The method according to claim 4, wherein the effect function curve is calculated as a spline function to the nth degree, and wherein n is an integer.

6. The method according to claim 1, wherein the effect function curve presents a circularly closed function graph.

7. The method according to claim 1, wherein the gradient of the effect function curve in a point of intersection is predetermined as a boundary condition for the calculation of the effect function curve.

8. The method according to claim 7, wherein the gradient of the effect function curve in a point of intersection is predetermined by entering a tangent to the effect function curve.

9. The method according to claim 1, wherein for creating the light effect, a plurality of lighting devices are simultaneously actuated, a separate effect function curve being calculated for each lighting device in the plurality of lighting devices.

10. The method according to claim 1, wherein the adjusting range plane is displayed at a screen of the lighting control console.

11. The method according to claim 10, wherein the points of intersection in the adjusting range plane are established by touching a touch-sensitive surface of the screen.

12. The method according to claim 1, wherein the selected adjusting value combinations from the effect function curve in each case have an equal distance on the effect function curve.

13. The method according to claim 1, wherein the effect function curve is calculated in real time and the adjusting value combinations from the effect function curve are selected in real time.

14. The method according to claim 4, wherein the effect function curve is calculated as a spline function to one of the second or third degree.

* * * * *